United States Patent [19]

Hellman et al.

[11] 3,939,538

[45] Feb. 24, 1976

[54] METHOD OF MAKING DISCHARGE LAMP HAVING BLOW-MOLDED ARC TUBE ENDS

[75] Inventors: Wayne R. Hellman, Euclid; Klaus Gottschalk, Solon; Edward C. De George, South Euclid, all of Ohio

[73] Assignee: General Electric Company, Schenectady, N.Y.

[22] Filed: Nov. 11, 1974

[21] Appl. No.: 522,825

Related U.S. Application Data

[62] Division of Ser. No. 374,566, June 28, 1973, Pat. No. 3,870,919.

[52] U.S. Cl. ..... 29/25.11; 65/110; 316/17

[51] Int. Cl.[2] ..... H01J 9/00

[58] Field of Search..... 29/25.11, 25.13, 25.1, 29/25.15, 25.16; 35/34, 140, 155, 156, 59 R, 59 A, 110, 276, 286, 292; 316/19, 20, 17, 1; 174/50.64; 313/220

[56] References Cited

UNITED STATES PATENTS

| | | | |
|---|---|---|---|
| 760,789 | 5/1904 | Hewitt | 316/26 |
| 2,235,515 | 3/1941 | Carpenter | 29/25.13 X |
| 2,844,919 | 7/1958 | Power | 174/50.64 X |
| 2,857,712 | 10/1958 | Yoder et al. | 65/155 |
| 2,965,698 | 12/1960 | Gottschalk | 174/50.64 |
| 3,290,134 | 12/1966 | Camarata | 65/140 |
| 3,324,332 | 6/1967 | Waymouth et al. | 313/220 |
| 3,593,056 | 7/1971 | Degawa et al. | 313/220 |
| 3,665,235 | 5/1972 | Hugot | 313/220 |

FOREIGN PATENTS OR APPLICATIONS

| | | | |
|---|---|---|---|
| 838,779 | 6/1960 | United Kingdom | 316/18 |

*Primary Examiner*—Roy Lake
*Assistant Examiner*—James W. Davie
*Attorney, Agent, or Firm*—Ernest W. Legree; Lawrence R. Kempton; Frank L. Neuhauser

[57] ABSTRACT

In arc discharge lamps containing a mixture of metals and halogen, and especially where an unvaporized excess of one metal is present, lamp color is very sensitive to end chamber shape. Color uniformity in production lamps using quartz arc tubes varying appreciably in diameter and wall thickness is greatly improved by molding end chambers of constant size and shape in the ends. The chamber may be formed at the time the end is pinched and the electrodes sealed in by using pinching jaws having a mold defining portion and momentarily pressurizing the arc tube to expand the heated and still plastic end into the mold. In production all lamps will have their ends expanded or belled to some extent, more in lamps close to the minimum diameter limit and less in lamps close to the maximum diameter limit.

6 Claims, 8 Drawing Figures

METHOD OF MAKING DISCHARGE LAMP HAVING BLOW-MOLDED ARC TUBE ENDS

This is a division of application Ser. No. 374,566, filed June 28, 1973, now U.S. Pat. No. 3,870,919.

BACKGROUND OF THE INVENTION

The invention relates to electric discharge lamps of the high pressure metal vapor type and is especially applicable to such lamps having a metallic halide fill.

High pressure metal vapor arc discharge lamps generally comprise an elongated arc tube made of quartz or fused silica and having pinches or press seals at each end. The arc tube contains a quantity of mercury along with an inert starting gas such as argon and is provided with electrodes at opposite ends supported by the press seals. Metallic halide lamps contain in addition to the mercury and starting gas one or more metal halides such as sodium, thallium, and indium iodides, or sodium and scandium iodides. In commercial lamps, the arc tube is generally enclosed within a vitreous outer envelope or jacket provided with a screw base at one end.

Arc tubes are now commonly made utilizing so-called full press seals wherein the entire end segment of a piece of quartz or fused silica tubing is collapsed and sealed off. This is done by pinching the ends of the quartz tube while in a heat-softened condition between a pair of opposed jaws to press the quartz about a foliated inlead supporting an electrode on its inner end. The jaws contact and compress only the end portions of the quartz tubes which form the press seals or pinches about the inleads. The immediately adjacent quartz which is viscous at the instant of pinching assumes a generally rounded shape in the transition zone between the cylindrical main body of the arc tube and the press seal which may be referred to as the end chamber. The shape or blow-out of the end chambers, that is of the space around and behind the electrodes, will vary with the type of quartz, the wall thickness, the heat concentration and the nitrogen pressure build-up at pressing.

With the conventional high pressure mercury vapor lamp of long standing, the specific shape of the end chambers is not particularly significant and there has been little concern over variations from lamp to lamp. Because such lamps operate with the mercury all vaporized, the metal vapor density is substantially independent of envelope temperature, and end chamber variations do not appreciably affect performance or electrical characteristics.

SUMMARY OF THE INVENTION

We have found that in the new metal halide lamps containing a quantity of mercury which is substantially all vaporized and a metal halide in excess of the quantity vaporized, the specific shape of the end chamber governs the location of the cold spot and thereby critically affects lamp performance and color. Lamps containing a limited quantity of mercury and an excess of sodium iodide, and this includes the great majority of all metal halide lamps sold commercially, are particularly sensitive to end chamber variations. The color of the lamp is determined by the balance between the mercury vapor pressure and the vapor pressures of the various metal halides. In installations containing more than one lamp, color variations resulting from differences in end chamber shape are immediately noticeable.

In acccordance with our invention, we have greatly improved color uniformity in production lamps using vitreous envelopes or arc tubes of quartz or quartzlike material varying appreciably in diameter and wall thickness, by molding end chambers of constant size and shape in the ends. By quartzlike material we intend high temperature glasses containing a high proportion of silica. In practice we segregate all arc tubes before pinching, into groups having diameters falling between maximum and minimum limits and having wall thicknesses likewise falling between predetermined limits. Thereafter, as part of the pinching or press sealing process, the tube ends in each size category are expanded to a constant end chamber size and shape slightly larger than the maximum limit in the category. All lamps will have their ends expanded or belled to some extent, more in lamps close to the minimum diameter limit and less in lamps close to the maximum diameter limit.

The end chambers may be formed at the same time the ends are pinched and the electrodes sealed in by using pinching jaws having a mold defining portion and momentarily pressurizing the arc tube to expand the heated and still plastic end into the mold. Jaws are used having mold portions adapted to the particular batch size of arc tubes being sealed. By molding the end chambers as part of pinch sealing, the processing of metal halide lamps having greatly improved operating characteristics may be done at normal machine speed without requiring extra labor.

DESCRIPTION OF PREFERRED EMBODIMENTS

Figure 1:
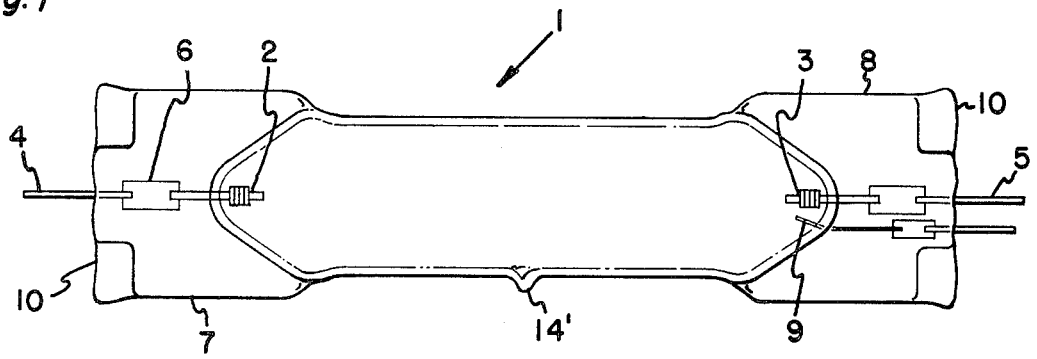
FIG. 1 is a front view of a quartz arc tube for a metal halide arc lamp provided with molded end chambers in accordance with the invention and illustrating average blow-out.

Referring to FIG. 1, there is shown a quartz or fused silica arc tube 1 suitable for mounting in the outer vitreous envelope or jacket of a metallic halide arc lamp similar to those disclosed in U.S. Pat. No. 3,234,421 — Reiling. Sealed into opposite ends of the tube are a pair of main discharge supporting electrodes 2, 3 supported on the distal ends of inleads 4, 5 which constitute the arc tube terminals. The electrode inleads include intermediate thin molybdenum foil sections 6 which are hermetically sealed through full diameter pinch seals 7, 8 at the ends of the arc tube. The main electrodes 2, 3 each comprise tungsten wire wrapped around a tungsten core wire and may include activating material. An auxiliary starting electrode 9 is provided at one end of the arc tube and consists merely of the inwardly projecting end of the inlead. The corners 10 of the pinch seals may be left unpressed to provide wells for the accomodation of supports in mounting the arc tube in an outer envelope or jacket.

By way of example, the arc tube may contain a quantity of mercury which is substantially entirely vaporized during operation of the lamp and which at such time exerts a pressure in the range of 1 to 15 atmospheres. A quantity of sodium iodide is provided in excess of that vaporized at the operating temperature of the arc tube. In well-known commercially available lamps there are provided in addition smaller amounts of thallium iodide and indium iodide, or of scandium iodide. The illustrated arc tube is of a size suitable for a 1000 watt lamp and would be mounted in a glass jacket filled with an inactive gas, suitably nitrogen at about ½ atmosphere pressure.

Prior Manufacturing Practice

Prior to our invention, the arc tube ends were pinch sealed using the conventional technique described in U.S. Pat. No. 2,965,698 — Gottschalk, and commercial production was by a quartz lamp sealing machine such as disclosed in U.S. Pat. No. 2,857,712 — Yoder et al. In such processing, a quartz tube is supported in a head of a pinch sealing machine and has its exhaust tubulation accomodated in a gas supply port providing nitrogen to prevent oxidation of the inleads during the sealing operation. The sealing or pinching proper is performed at a station where oxyhydrogen burners heat the lower end of the quartz tube to a plastic state. At the proper moment, the burners are withdrawn and a pair of pinching jaws are rapidly moved firstly up into alignment with the lower end of the quartz tube and then in horizontally against the sides of the tube. If this is the first end of the quartz tube to be sealed, the other end is stoppered. At the moment of pinching, the end chamber is formed by the back pressure of nitrogen which forces the soft quartz outward. The shape of the end chamber is determined by the viscosity of the quartz which is temperature dependent, the nitrogen back pressure, and the jaw closing speed.

Figure 6:
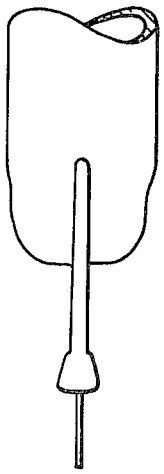
Fig. 6 PRIOR ART
FIGS. 6, 7 and 8 are fragmentary views of tube ends showing the variation in end chamber shape in the absence of end molding.
Figure 7:
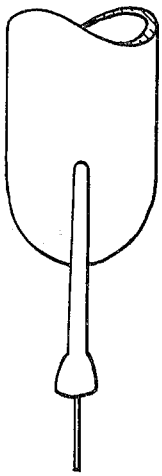
Fig. 7 PRIOR ART
Figure 8:
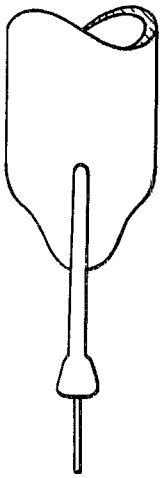
Fig. 8 PRIOR ART

A major factor determining the temperature of the quartz at pinching is the tubing wall thickness. The manufacturing process by which fused silica tubes are drawn does not permit precise and constant control of wall thickness. Since the rate of heating is dependent on wall thickness, this means that the temperature of the quartz tubing at pinching cannot be accurately controlled and the result has been the production of end chamber shapes such as illustrated in FIGS. 6, 7 and 8. The bulb of FIG. 6 is overblown, a condition usually due to thin-walled tubing; that of FIG. 7 is average and generally represents the desired shoulder shape; that of FIG. 8 is underblown, probably the result of thick-walled tubing. In operation, the lamp of FIG. 6 will have a lower cold spot temperature and hence a higher color temperature; the lamp of FIG. 8 will have a higher cold spot temperature, hence more sodium will be vaporized and a lower color temperature in the direction of yellow-range will result.

Blow Molding Practice

In accordance with our invention, we have greatly improved color uniformity in lamps using production fused-silica or quartz tubing varying appreciably in diameter and wall thickness by molding end chambers of constant size and shape in the ends at the same time as they are pinched or press sealed. We have found it desirable to segregate the quartz tubes before pinching into groups having diameters falling between maximum and minimum limits, and into subgroups having wall thicknesses likewise falling between predetermined limits. By way of example, arc tubes for 1000 watt lamps are sorted into one size having an outer diameter ranging from 24.2 to 25.7 millimeters for which pinching jaws providing an opening 25.8 millimeters in diameter are used, and another size ranging from 25.8 to 26.5 millimeters for which pinching jaws of 26.6 millimeters are used. It may be desirable to further sort each group into sub groups according to wall thickness and compensate for variations in thickness by adjusting the intensity of the heating fires, the duration of the heating time or the pressure of nitrogen at the instant of molding. As part of the pinching or press sealing process, all tubes in each group are expanded to a constant end chamber size and shape corresponding to the 25.8 millimeter jaws in the case of the first group, or the 26.6 millimeter jaws in the case of the second group.

Figure 2:
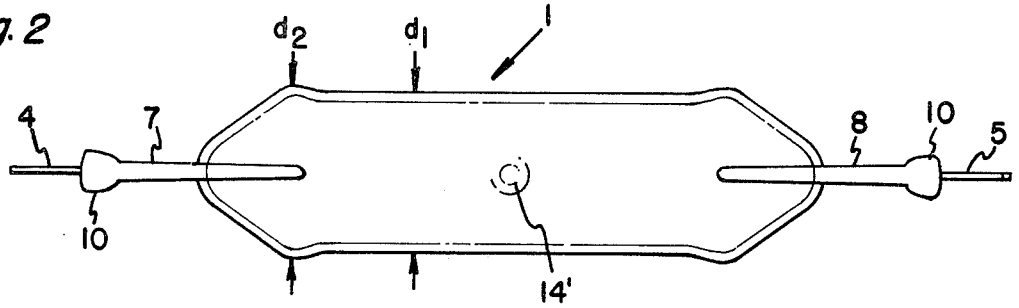
FIG. 2 is a side view of the same arc tube shown in FIG. 1.
Figure 3:
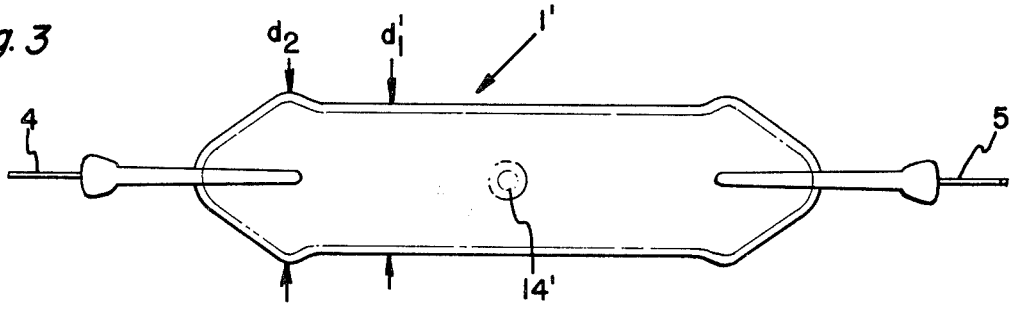
FIG. 3 is a side view of an arc tube of the same size category illustrating maximum blow-out.

In accordance with our invention, all lamps will have their ends belled or expanded beyond diameter of the central part of the tubing to some extent, more so in lamps close to the minimum diameter limit in each group and less so in lamps close to the maximum diameter limit. Uniformity of end chamber shape and size is what is important for color uniformity in a batch of lamps, and the extent of belling or expansion in forming the end chamber is not critical. Substantial color uniformity in metal halide lamps may be achieved with expansion of the ends of the tubes in a range from 0.1 up to 10 percent. Expansion may be measured as the ratio $(d_2 - d_1)/d_1$, where $d_1$ is the tube diameter subject to manufacturing tolerances, and $d_2$ is the constant diameter of the mold into which the end is expanded. In practice we prefer to use a smaller range from approximately 0.4 to about 4 percent as in the foregoing example of a 1000 watt lamp. Arc tube 1 illustrated in FIGS. 1 and 2 is representative of an average degree of belling while arc tube 1' in FIG. 3 shows a tube diameter $d_1'$ near the minimum limit and a large degree of belling near the upper practical limit.

METHOD AND APPARATUS

Figure 4:
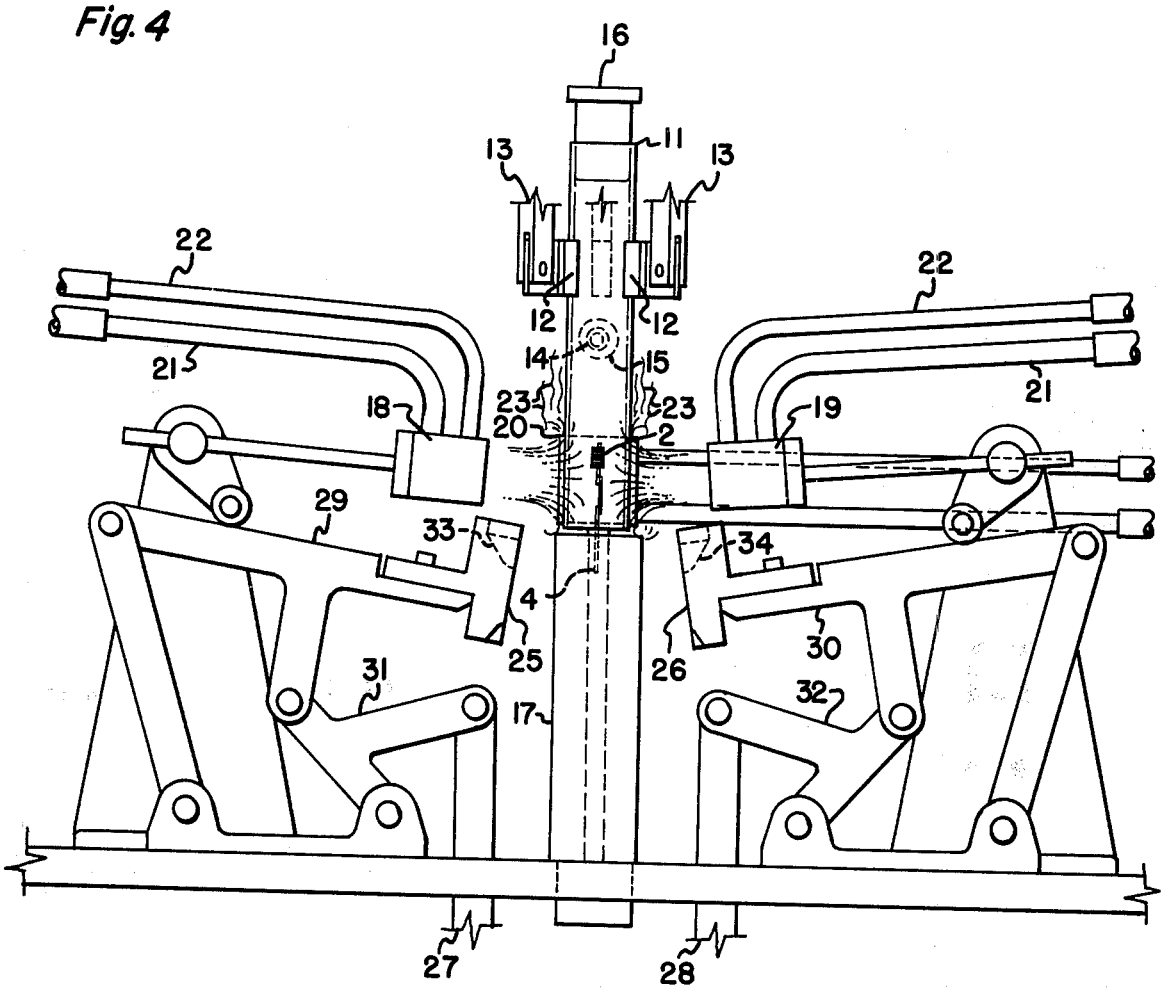
FIG. 4 is a front elevation of a pinch sealing mechanism which may be used to pinch and end form the arc tube illustrated in FIG. 1.
Figure 5:
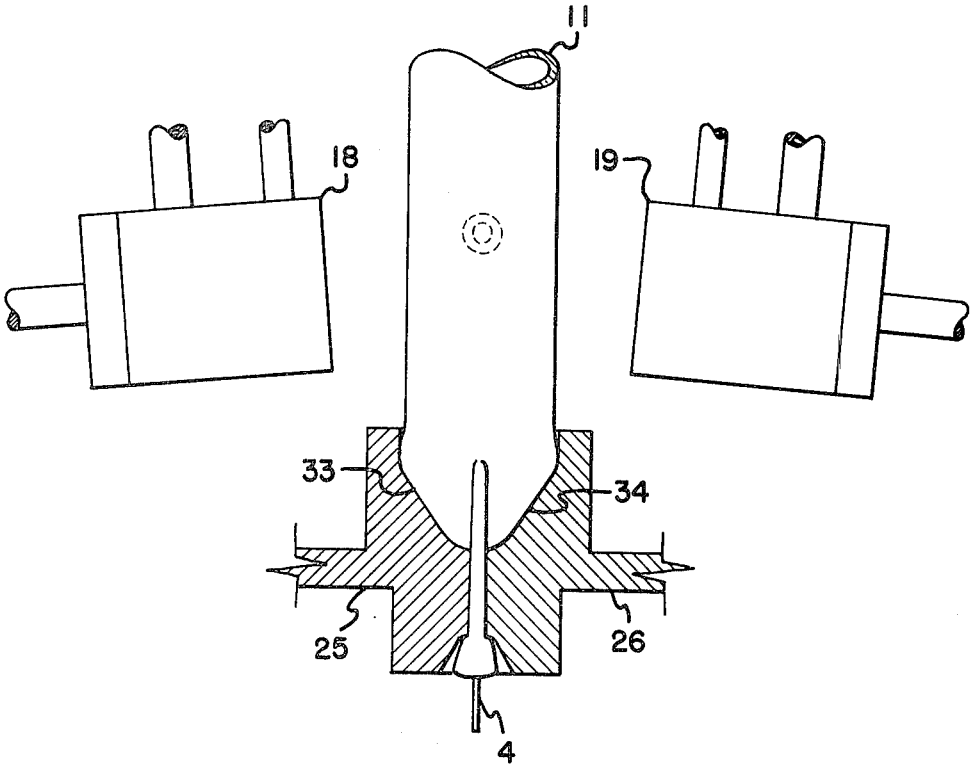
FIG. 5 is a detail of the mechanism showing the burners lifted out of the way and the jaws closed about the tube end.

The ends of a quartz tube may be press-sealed or pinched and simultaneously blow-molded using the apparatus illustrated in FIGS. 4 and 5. The quartz tube 11 is held vertically in jaws 12 on the lower ends of pivotable arms 13 which are part of a sliding head which may be lowered into the station. A side tubulation or exhaust tube 14 extends from behind at right angles to the axis of the quartz tube and a flexible tube 15 supplying inactive gas, suitable nitrogen, is connected to it. When the first pinch seal is being made on an arc tube, the open top end of the tube is closed by a suitable temperature-resistant stopper such as plug 16; no plug is needed when the second pinch seal is being made. The nitrogen prevents oxidation of the leads and electrodes during heating and pinching. Lead wire 4 which supports electrode 2 is accommodated in a spindle 17 and the arc tube is supported with its lower edge just clearing the face of the spindle.

The lower end of the quartz tube is heated by two pairs of opposed burners; one pair 18, 19 is fully illustrated; and another pair comprises burner 20 behind the quartz tube and another burner complementary thereto which is not shown to avoid obstructing the view. The burners feed mixed jets of hydrogen and oxygen supplied to them through tubes 21, 22; the oxyhydrogen flames 23 completely envelop the lower end of the quartz tube and heat it to plasticity. The heating time may be regulated by a timer or by a temperature sensing device.

At the conclusion of the heating cycle, at which time the lower end of the quartz tube is white hot and in a plastic condition, the pinching jaws 25, 26 are actuated by downward movement of rods 27, 28. The jaws are fastened to the facing ends of T-shaped levers 29, 30 to which rods 27, 28 are connected by links 31, 32. The initial movement causes the pinching jaws to pivot up into substantially horizontal positions level with the lower end of the arc tube. At the same time burners 18, 19 are pivoted up and out of the way. Continued downward movement of the actuating rods 27, 28 then causes the T-shaped levers to move horizontally together, the jaws thereupon engaging the lower end of the arc tube and flattening or pinching it as illustrated in FIG. 5. At this moment, the pressure of nitrogen within the arc tube is increased in order to expand the plastic lower end into conformance with the generally conical mold defined by surfaces 33, 34 in the upper portions of the pinching jaws. The nitrogen pressure is then relieved, the jaws withdrawn and the arc tube allowed to cool.

The arc tube may then be inverted in its holder and the pinch or press seal at the other end made in the same fashion. Simultaneous pinching and blow-molding according to the invention may be done on other lamp machinery, for instance on the quartz lamp sealing machine of U.S. Pat. No. 2,857,712 — Yoder. The manufacture of the arc tube is then completed in conventional fashion which involves exhaust of the sealed arc tube, introduction of mercury, metal or metal halides, and inert starting gas such as argon, and finally tipping off the exhaust tube as indicated at 14'. Finished lamps usually include a protective outer glass jacket in which the arc tube is sealed.

Metal halide arc lamps having blow-molded end chambers in accordance with our invention show greatly improved operating characteristics and color uniformity. Because the end chamber shape is controlled by the mold rather than the vagaries of fused silica tubing production, every end chamber shape is the same independently of quartz tube diameter or thickness. The color of the lamp is determined primarily by the balance between mercury vapor pressure and metal halide, particularly sodium iodide, vapor pressure. The metal halide being in excess, its vapor pressure is determined by the temperature of the cold spot in the lamp where the unvaporized excess collects. In lamps according to our invention, the cold spot is at the lower end of the arc tube and the expansion or belling thereof to a constant uniform size assures uniformity of color among all arc tubes belonging to that size category.

While we prefer to expand or bell both ends of the arc tube, it is only the lower end in operation which it is important to have constant in size and shape. The upper end can be allowed to vary with little effect on performance. For horizontally operated lamps, it is desirable to bell both ends.

What we claim as new and desire to secure by Letters Patent of the United States is:

1. In a method of making an electric arc tube the improvement which comprises:

placing an end of a tube of vitreous quartzlike material of a given diameter around an inlead conductor;

heating said end to plasticity while flowing an inactive gas through the tube;

compressing said end to seal the material about the inlead;

forming a mold about the tube next to the compressed end;

and pressurizing said tube with inactive gas in order to expand the region of the tube next the compressed end into the mold to a diameter greater than said given diameter whereby to achieve an end chamber of constant size and shape.

2. The method of claim 1 wherein the compressing of the end of the tube and the expansion thereof into the mold are done together.

3. The method of claim 1 wherein the compressing of the end of the tube is done by closing jaws thereon which simultaneously define a mold, and the expansion of the tube into the mold thus formed is done at the same time.

4. In a method of making electric arc tubes from tubes of vitreous quartzlike material varying in diameter the improvement which comprises:

segregating the tubes into groups where the diameter varies between predetermined limits;

pinch sealing the ends of said tubes by compressing them about inleads while heated to plasticity;

and belling and expanding at least one end of the tubes to a diameter slightly larger than the maximum limit in the group into which they have been segregated.

5. The method of claim 4 wherein the pinch sealing of the ends of the tube and the belling and expansion thereof are done together.

6. The method of claim 4 wherein the pinch sealing of the end of the tube is done by closing jaws thereon which simultaneously define a mold, and expansion of the tube into the mold thus formed is done at the same time.

* * * * *